US006071661A

United States Patent [19]

Hsieh et al.

[11] Patent Number: 6,071,661

[45] Date of Patent: Jun. 6, 2000

[54] IMAGING MEMBER CONTAINING BRANCHED POLYCARBONATE

[75] Inventors: Bing R. Hsieh; Satchidanand Mishra, both of Webster; Anthony M. Horgan, Pittsford; Richard L. Post, Penfield; Robert C. U. Yu, Webster; Donald C. VonHoene, Fairport; Edward F. Grabowski, Webster; Kathleen M. Carmichael, Williamson, all of N.Y.

[73] Assignee: Xerox Corporation, Stamford, Conn.

[21] Appl. No.: 09/342,389

[22] Filed: Jun. 29, 1999

[51] Int. Cl.[7] ..... G03G 15/04

[52] U.S. Cl. ..... 430/67; 430/69; 430/930

[58] Field of Search ..... 430/67, 69, 930

[56] References Cited

U.S. PATENT DOCUMENTS

| | | | |
|---|---|---|---|
| 4,663,391 | 5/1987 | Boutni | 525/146 |
| 4,931,372 | 6/1990 | Takei et al. | 430/66 |
| 5,283,142 | 2/1994 | Mayama et al. | 430/58 |
| 5,521,041 | 5/1996 | Miyamoto et al. | 430/58 |
| 5,665,501 | 9/1997 | Derks et al. | 430/59 |
| 5,876,887 | 3/1999 | Chambers et al. | 430/58 |

OTHER PUBLICATIONS

Ludwig Bottenbruch (editor), Engineering Thermoplastics, Polycarbonates, Polyacetals, Polyesters, Cellulose Esters (Hanser Publishers 1996) (8 pages).

*Primary Examiner*—Mark Chapman
*Attorney, Agent, or Firm*—Zosan S. Soong

[57] ABSTRACT

An imaging member including: (a) a substrate layer; (b) an imaging layer; and (c) an abrasion resistant layer selected from the group consisting of an overcoating layer and an anti-curl layer, wherein the abrasion resistant layer includes a branched polycarbonate.

14 Claims, 1 Drawing Sheet

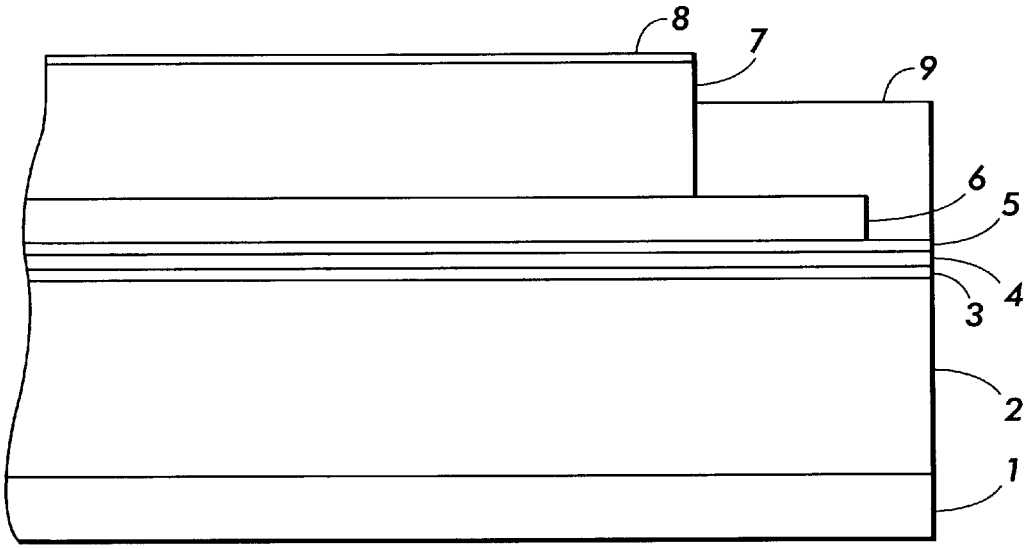
8
7
9
6
5
4
3
2
1

IMAGING MEMBER CONTAINING BRANCHED POLYCARBONATE

FIELD OF THE INVENTION

This invention relates to imaging members, particularly photoreceptors, having an anti-curl layer, an overcoating layer, or both.

BACKGROUND OF THE INVENTION

The top surface and the bottom surface of a moving web or belt type photoreceptors may be in contact with backer bars and back cleaners inside the printing machine. Such contact abrades the surfaces of the photoreceptor and may eventually wear away enough of the photoreceptor to impair its function. Another source of wear of the top surface of a photoreceptor comes from electrochemical reaction of the corona charging devices. Abrasion resistant materials are desirable for the top and bottom surfaces of the photoreceptor to prolong its life. The present invention addresses the problem of abrasion of the imaging member by providing new materials with enhanced abrasion resistance for the anti-curl layer and the overcoating layer.

Conventional photoreceptors are disclosed in Chambers et al., U.S. Pat. No. 5,876,887; Miyamoto et al., U.S. Pat. No. 5,521,041; Derks et al., U.S. Pat. No. 5,665,501.

A polycarbonate composition is disclosed in Boutni, U.S. Pat. No. 4,663,391.

Polycarbonates, including branched and linear polycarbonates, are described in Ludwig Bottenbruch (editor), "Engineering Thermoplastics, Polycarbonates, Polyacetals, Polyesters, Cellulose Esters (Hanser Publishers 1996), the disclosure of which is totally incorporated herein by reference (eight (8) pages).

SUMMARY OF THE INVENTION

The present invention is accomplished in embodiments by providing an imaging member comprising:

(a) a substrate layer;
(b) an imaging layer; and
(c) an abrasion resistant layer selected from the group consisting of an overcoating layer and an anti-curl layer, wherein the abrasion resistant layer includes a branched polycarbonate.

There is also provided in embodiments an imaging member comprising:

(a) an anti-curl layer including a first branched polycarbonate;
(b) a substrate layer;
(c) a first imaging layer; and
(d) a second imaging layer.

In still other embodiments, there is provided an imaging member comprising:

(a) a substrate layer;
(b) a first imaging layer;
(c) a second imaging layer; and
(d) an overcoating layer including a branched polycarbonate.

BRIEF DESCRIPTION OF THE DRAWING

The FIGURE is a cross-sectional view of a multi-layer photoreceptor of the present invention.

DETAILED DESCRIPTION

A representative structure of an electrophotographic imaging member is shown in the FIGURE. This imaging member is provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. The imaging member can be a photoreceptor.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'isopropylidene diphenylcarbonate), poly(4,4'-cyclohexylidene diphenylcarbonate, mixtures thereof and the like.

A preferred resin binder for the anti-curl layer is a branched polycarbonate. The preferred branched polycarbonate is bisphenol A branched polycarbonate which is produced by incorporating a low concentration of a tri- or multi-functional monomers during polycarbonate synthesis with bisphenol A and phosgene as the main monomers. The branching density can be controlled by the concentration of the tri- or multifunctional monomers. A preferred tri-functional monomer is 4,4',4"-(1,3,5-Benzenetriyltris(1-methylethylidene))tris(phenol) and a preferred tetrafunctional monomer is 1,4-bis(4',4"-dihydroxytriphenylmethyl) benzene. Another preferred branched polycarbonate is 4,4'-cyclohexylidene bisphenol branched polycarbonates using 4,4',4"-(1,3,5-Benzenetriyltris(1-methylethylidene))tris (phenol) or 1,4-bis(4',4"-dihydroxytriphenylmethyl)benzene as the branching agents. Another preferred branched polycarbonate is a N,N'-diphenyl-N,N'-bis(3-hydroxyphenyl)-1,1'-biphenyl-4,4'-diamine or a N,N'-diphenyl-N,N'-bis(4-hydroxyphenyl)-1,1'-biphenyl-4,4'-diamine branched polycarbonate using 4',4"-(1,3,5-Benzenetriyltris(1-methylethylidene))tris(phenol) or 1,4-bis(4',4"-dihydroxytriphenylmethyl)benzene as the branching agents.

One or more branched polycarbonates may be present in an amount of 100% by weight based on the anti-curl layer. Where the binder for the anti-curl layer is a blend, a branched polycarbonate may be present in an amount ranging for example from about 10% to about 90% by weight of the blend, the remainder being a polycarbonate that is not branched or a resin that is not a polycarbonate. A binder blend of two or more branched polycarbonates may be employed, optionally with one or more other resins.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a mulilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where the preferred aluminum drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms;

more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 can include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110.

A preferred hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278 to Teuscher et al.

The blocking layer 4 should be continuous and can have a thickness of up to 2 micrometers depending on the type of material used.

However, the blocking layer preferably has a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer is preferred for blocking layers for optimum electrical behavior.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 5.0:100 is satisfactory for spray coating.

The Adhesive Layer

An intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like.

The Imaging Layer(s)

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. The photoreceptors embodying the present invention can be prepared by applying over the electrically conductive layer the charge generation layer 6 and, optionally, a charge transport layer 7. In embodiments, the charge generation layer and, when present, the charge transport layer, may be applied in either order.

Ilustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Ilustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The Overcoating Layer

Embodiments in accordance with the present invention can, optionally, further include an overcoating layer or layers 8, which, if employed, are positioned over the charge generation layer or over the charge transport layer, if one is present. This layer comprises organic polymers or inorganic polymers that are electrically insulating or slightly semiconductive. Materials described herein for the anti-curl layer also may be suitable for the overcoating layer. In embodiments, the overcoating layer may have the same composition as the anti-curl layer.

Such a protective overcoating layer includes a film forming resin binder optionally doped with a charge transport material. In embodiments, there is absent any charge transport material in the overcoating layer.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include Makrolon, a polycarbonate resin having a weight average molecular weight of about 50,000 to about 100,000 available from Farbenfabriken Bayer A. G., 4,4'cyclohexylidene diphenyl polycarbonate, available from Mitsubishi Chemicals, high molecular weight Lexan 135, available from the General Electric Company, Ardel polyarylate D-100, available from Union Carbide, and polymer blends of Makrolon and the copolyester Vitel PE-100 or Vitel PE-200, available from Goodyear Tire and Rubber Co.

A preferred resin binder for the overcoating layer is a branched polycarbonate. The branched polycarbonates that are useful in the anti-curl layer can be used for the overcoating layer. One or more branched polycarbonates may be present in an amount of 100% by weight based on the overcoating layer. The overcoating layer and the anti-curl layer may use the same or different branched polycarbonate. Where the binder is a blend, a branched polycarbonate is present in an amount ranging for example from about 10% to about 90% by weight of the blend, the remainder being a polycarbonate that is not branched or a resin that is not a polycarbonate. A binder blend of two or more branched polycarbonates may be employed, optionally with one or more other resins.

In embodiments, a range of about 1% by weight to about 10% by weight of the overcoating layer of Vitel copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like. Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

A branched polycarbonate, MAKROLON™ 8959 (molecular weight of 39,000) doped with 30 weight percent of N,N'-diphenyl-N,N'-di(m-methylphenyl)(1,1'-biphenyl)-diamine was spray coated on an aluminum roll substrate (1 inch in diameter and 12.5 inches in length) using methylene chloride and 1,1,2-trichloroethane as the solvents. The thickness of the coating on the test roll was about 25 to about 27 micrometers. The coated test roll was then mounted in a developer housing for wear test against a magnetic brush roll loaded with magnetic bare magnetic carrier beads (65 micrometers). This was a stress condition because of the absence of toner particles. The test roll was mounted in the developer housing so that its longitudinal axis was parallel to that of the magnetic brush roll. The spacing between the magnetic brush roll and the test roll for wear test was about 40 mils. The magnetic brush roll was operated at a surface speed of 4.8 inch/second and the test roll at 65 inch/second. The coated test roll was taped around its circumference with 3M Scotch tape in the form of alternating tape band and no tape band regions. This allowed the wear of the surface profile of the roll to be measured from an unprotected to a protected area and to an unprotected area of the test roll using a surface profilometer. The profilometer was a Surfcom stylus-measuring instrument and it had a sensitivity of 1 micrometer per cm recorded on a strip chart paper. The surface profile of the test roll was measured at every 2 million (M) revolutions as counted by use of an inductive sensor and display circuit. The test roll was then removed from the developer housing and a single band of the tape was removed from the circumference of the roll. The surface profile of the test roll was then measured as described above to determine the amount of wear of the unprotected area versus the protected area of the test roll. The test roll was then returned to the developer housing. The wear fixture was then run for another 2M cycles of the test roll and the measurement of wear was repeated in another region on the surface of the roll. The procedure was repeated until the roll had 10M cycles of operation in the developer housing or the roll had failed completely and the metal core of the substrate was exposed. The thickness of wear was then plotted against the number of cycles. From the plot, a low wear rate in the range of 0.7–1.1 micrometer/Mcycle was found for the branched Makrolon 8959.

COMPARATIVE EXAMPLE 1

The procedures of Example 1 were carried out except that a linear polycarbonate, MAKROLON™ 3108 doped with 30 weight percent of N,N'-diphenyl-N,N'-di(m-methylphenyl)(1,1'-biphenyl)-diamine, was used. A relatively high wear rate of 6–12 micrometer/Mcycle was found, which is about 10 times higher than the branched polycarbonate shown in Example 1.

COMPARATIVE EXAMPLE 2

The procedures of Example 1 were carried out except that a different linear polycarbonate (4,4'-cyclohexylidene diphenyl polycarbonate, molecular weight of 100,000 available from Mitsubishi Chemicals) doped with 30 weight percent of N,N'-diphenyl-N,N'-di(m-methylphenyl)(1,1'-biphenyl)-diamine was used. This polycarbonate showed a wear rate of 6–12 micrometer/Mcycle, which is also about 10 times higher than the branched polycarbonate, even though this linear polycarbonate had more than 2 times higher molecular weight than the branched polycarbonate of Example 1.

Other modifications of the present invention may occur to those skilled in the art based upon a reading of the present disclosure and these modifications are intended to be included within the scope of the present invention.

We claim:

1. An imaging member comprising:

(a) a substrate layer;

(b) an imaging layer; and (c) an abrasion resistant layer selected from the group consisting of an overcoating layer and an anti-curl layer, wherein the abrasion resistant layer includes a branched polycarbonate.

2. The imaging member of claim 1, wherein the imaging member is a belt or a web.

3. The imaging member of claim 1, wherein the branched polycarbonate is selected from the group consisting of a bisphenol A branched polycarbonate; a 4,4'-cyclohexylidene bisphenol branched polycarbonate; a N,N'-diphenyl-N,N'-bis(3-hydroxyphenyl)-1,1'-biphenyl-4,4'-diamine; and a N,N'-diphenyl-N,N'-bis(4-hydroxyphenyl)-1,1'-biphenyl-4,4'-diamine branched polycarbonate.

4. An imaging member comprising:

(a) an anti-curl layer including a first branched polycarbonate;

(b) a substrate layer;

(c) a first imaging layer; and (d) a second imaging layer.

5. The imaging member of claim 4, wherein the first imaging layer is a charge generating layer and the second imaging layer is a charge transport layer.

6. The imaging member of claim 4, wherein the first branched polycarbonate is selected from the group consisting of a bisphenol A branched polycarbonate; a 4,4'-cyclohexylidene bisphenol branched polycarbonate; a N,N'-diphenyl-N,N'-bis(3-hydroxyphenyl)-1,1'-biphenyl-4,4'-diamine; and a N,N'-diphenyl-N,N'-bis(4-hydroxyphenyl)-1,1'-biphenyl-4,4'-diamine branched polycarbonate.

7. The imaging member of claim 4, further comprising (e) an overcoating layer.

8. The imaging member of claim 7, wherein the overcoating layer includes a second branched polycarbonate.

9. The imaging member of claim 8, wherein the second branched polycarbonate is selected from the group consisting of a bisphenol A branched polycarbonate; a 4,4'-cyclohexylidene bisphenol branched polycarbonate; a N,N'-diphenyl-N,N'-bis(3-hydroxyphenyl)-1,1'-biphenyl-4,4'-diamine; and a N,N'-diphenyl-N,N'-bis(4-hydroxyphenyl)-1,1'-biphenyl-4,4'-diamine branched polycarbonate.

10. The imaging member of claim 8, wherein the first branched polycarbonate and the second branched polycarbonate are the same.

11. An imaging member comprising:

(a) a substrate layer;

(b) a first imaging layer;

(c) a second imaging layer; and (d) an overcoating layer including a branched polycarbonate.

12. The imaging member of claim 11, wherein the first imaging layer is a charge generating layer and the second imaging layer is a charge transport layer.

13. The imaging member of claim 11, further comprising an anti-curl layer adjacent to the substrate layer.

14. The imaging member of claim 11, wherein the branched polycarbonate is selected from the group consisting of a bisphenol A branched polycarbonate; a 4,4'-cyclohexylidene bisphenol branched polycarbonate; a N,N'-diphenyl-N,N'-bis(3-hydroxyphenyl)-1,1'-biphenyl-4,4'-diamine; and a N,N'-diphenyl-N,N'-bis(4-hydroxyphenyl)-1,1'-biphenyl-4,4'-diamine branched polycarbonate.

* * * * *